United States Patent [19]

Finger et al.

[11] 3,970,048

[45] July 20, 1976

[54] LOW PRESSURE STEAM GENERATOR

[75] Inventors: John F. Finger; Merle E. Pachop, both of Beresford, S. Dak.

[73] Assignee: Sioux Steam Cleaner Corporation, Beresford, S. Dak.

[22] Filed: Mar. 6, 1975

[21] Appl. No.: 555,810

[52] U.S. Cl. ..... 122/328; 122/276; 122/451 R

[51] Int. Cl.[2] ..... F22B 21/22

[58] Field of Search ..... 122/140, 235 R, 236, 122/276, 328, 451 R

[56] References Cited

UNITED STATES PATENTS

| | | | |
|---|---|---|---|
| 2,684,663 | 7/1954 | Oxford | 122/276 |
| 3,107,656 | 10/1963 | McNeal | 122/328 |
| 3,382,848 | 5/1968 | Northcote et al. | 122/235 |
| 3,386,420 | 6/1968 | Cleaver et al. | 122/235 |
| 3,638,621 | 2/1972 | Craig | 122/140 |

*Primary Examiner*—Kenneth W. Sprague
*Attorney, Agent, or Firm*—Merchant, Gould, Smith, Edell, Welter & Schmidt

[57] ABSTRACT

A low pressure steam generator including a water tube structure of plural, substantially annular coaxial portions each connected individually by separate conduits to a steam header above and a water header below. The portions coact with suitable baffle means to comprise a combustion chamber, but are significantly spaced to allow combustion products to pass between them from a burner directing a flame axially within the chamber, and the greater part of the combustion products are directed upward by the baffle means to bathe the steam header outside the combustion chamber as well. Means are provided for maintaining the water to be vaporized at a suitable level, and the whole is enclosed in a suitable housing to the top and bottom of which the headers are secured. The tube structure may be a continuous helix or an array of discrete annuli.

5 Claims, 5 Drawing Figures

LOW PRESSURE STEAM GENERATOR

BACKGROUND OF THE INVENTION

This invention relates to steam generators and particularly to steam generators for such uses as soil sterilization where only a very low steam pressure is necessary and the stringent requirements of the steam engineering code are inappropriate and unduly onerous.

Soil sterilization is one of a number of fields where there is need for a source of steam at relatively low pressure which can readily be transported to a location of use, and which is sufficiently free from the hazards normally accompanying steam generators to obviate the need for a stationary engineer in constant attendance.

The present invention comprises a generator in which a water tube structure is connected between a water header below it and a steam header above it. This structure comprises a plurality of portions, each of substantially annular configuration, which in practice either may constitute the successive turns of a tubular helix having its ends closed, or may comprise a plurality of coaxial, completely independent tubular rings or annuli. In either case, the structure has a horizontal axis, and the tops of all the portions are connected by independent conduits to the steam header above, while the bottoms of all the portions are connected, again by independent conduits, to the water header below.

The portions are closely but not tightly spaced axially, and baffle means are provided at each end. There is thus defined a combustion chamber, and an oil or other burner is arranged to direct a flame axially into the chamber through the baffle means at one end. For the most part, the products of combustion leave the chamber at the other end, but some of the products pass upwardly between the portions of the water tube structure. The baffle means is arranged so that after leaving the chamber, the principal portion of the combustion products is also deflected to pass around the steam header.

The components just described are mounted in a suitable housing with air inlet and outlet openings, fuel and water supply lines, the latter including a level control system, and a steam outlet line including a pressure relief valve. This gives a convenient, safe, self-contained unit which may be transported readily to a field location for supplying low pressure steam where it is needed.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figures 1, 2, 3, 4, 5:
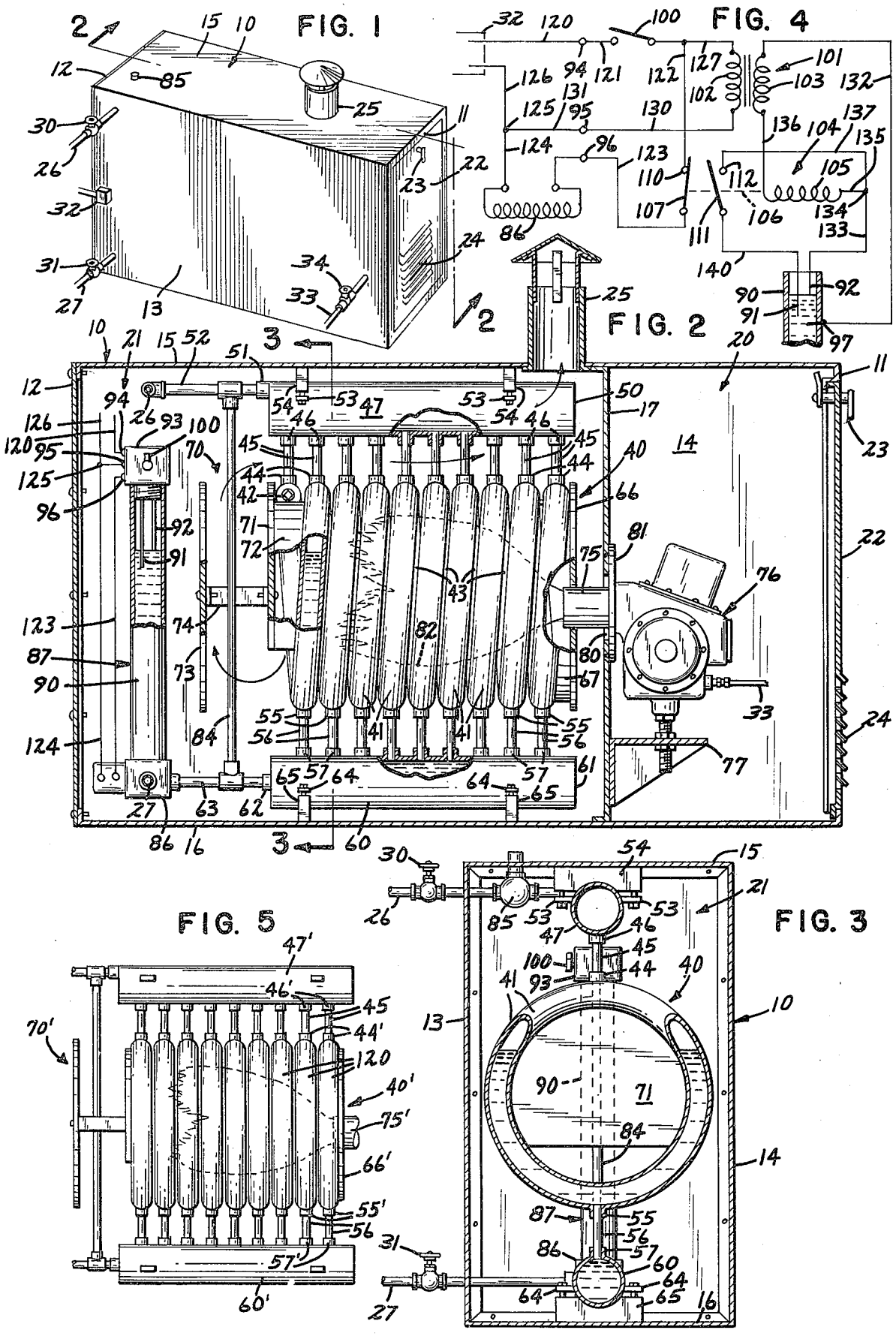
FIG. 1 is a perspective view of a first embodiment of the invention.
FIG. 2 is a longitudinal vertical section taken at 2—2 in FIG. 1.
FIG. 3 is a transverse vertical section taken at 3—3 in FIG. 2.
FIG. 4 is a schematic diagram of a level control circuit.
FIG. 5 is a fragmentary showing generally like FIG. 2 of a second embodiment of the invention.

As shown in FIG. 1, the steam generator of the invention is contained in a rectangular housing 10 having ends 11 and 12, sides 13 and 14, a top 15, and a bottom 16, and divided by a partition 17 into a burner chamber 20 and a generator chamber 21. End 11 may be formed as an access door 22 having a latch 23, and is louvered at 24 to admit combustion air to burner chamber 21. A vent or chimney 25 in top 15 conducts spent combustion products from chamber 20. End 12 may be removable to afford convenient access to chamber 20. Side 13 is provided with a steam outlet conduit 26 and a water inlet conduit 27, which may include manual valves 30 and 31, respectively, if desired, and with an electrical input connector 32 and a fuel input conduit 33 which may also have a manual valve 34 and which may lead to a fuel tank portable with the generator itself.

Contained in chamber 21 is a water tube structure 40 made up of a plurality of substantially annular portions 41 comprising successive terms of a continuous helix of tubular material such, for example, as two inch iron pipe. At each end of the helix there is a closure such as plug 42, only one of which is shown. The axis of the helix is horizontal, and the several turns or portions are closely but not tightly spaced, so that significant gaps exist between successive portions as at 43.

Taps 44 are provided at the tops of the several portions, and are connected by conduits 45 to a like set of taps 46 in the bottom of an elongated hollow steam header 47 which extends above structure 40 in a direction parallel to its axis. Header 47 is closed at one end and its other end is provided with a tap 51 to receive a steam outlet conduit 52: the header is formed with ears 53 by which it may be bolted to saddles 54 carried by housing top 15.

Taps 55 are also provided at the bottom of the several portions, and are connected by conduits 56 to a like set of taps 57 in the top of an elongated hollow water header 60 which extends below the structure 40 in a direction parallel to its axis. Header 60 is closed at one end 61, and its other end is provided with a tap 62 to receive a water inlet conduit 63: the header is provided with ears 64 by which it may be bolted to saddles 65 secured to housing bottom 16.

The generator also includes baffle means which cooperate with the tube structure to comprise a combustion chamber. A first baffle plate 66 is mounted at one end of the structure by a suitable bracket 67, and a baffle structure 70 includes a second baffle plate 71 secured to the other end of the structure by second bracket 72. Plate 66 substantially closes the adjacent end of structure 70, but the lower part of plate 72 is cut away. A further, complete baffle plate 73 is included in baffle structure 70, and is supported outside the combustion chamber in spaced relation to plate 71 by brackets 74, one of which is shown in FIG. 2.

Baffle plate 66 is centrally apertured to pass the nozzle 75 of a conventional gun type of oil burner 76. The burner is supported on partition 17 by means including a bracket 77, and nozzle 75 projects through partition 17 at an opening 80 closed around the nozzle by a collar 81. During operation, the burner produces an axially directed flame 82 in the combustion chamber, taking in fuel through conduit 33 and air through louvers 24.

A condensation feedback connection 84 is shown leading from steam outlet conduit 52 to water inlet conduit 63. Conduit 52 is continued through a pressure relief valve 85 to conduit 26. Conduit 63 is continued through the valve 86 of a level control system 87 to water inlet conduit 27.

In addition to valve 86, which is electrically operated as by a solenoid and is normally closed when not electrically energized, system 87 comprises a vertical stand-pipe 90 which is continuously in communication with the water header, a pair of mutually insulated probes 91 and 92 which project downwardly into and are insulated from the stand-pipe, probe 91 being longer than probe 92, and a control unit 93 having electrical terminals 94, 95 and 96 and enclosing the electrical components of the system. Stand-pipe 90 may be of electrically conductive material or may have an electrode 97 passing therethrough at a point below the tip of probe 91.

The system components include a single pole, single throw switch 100, a transformer 101 having a primary winding 102 and a secondary winding 103, and a relay 104 having a winding 105 which may be energized with alternating current to actuate an armature 106, displacing a first movable contact 107 out of normal engagement with a first fixed contact 110, and displacing a second movable contact 111 into engagement with a second fixed contact 112.

The circuit shown in FIG. 4 is energized from electrical connector 32, and it will be realized that electrical ignition of burner 76 may also be supplied from connector 32 if desired.

The circuit of FIG. 4 operates as follows. Assume that stand-pipe 90 is empty or that the water level there is below the point of probe 91. When switch 100 is closed, a circuit may be traced from connector 32 through conductor 120, terminal 94, conductor 121, switch 100, conductor 122, relay contacts 110 and 107, conductor 123, valve 86, conductor 124, junction point 125 and conductor 126 back to connector 32: valve 86 is thus energized and opens to admit water from conduit 27 to conduit 63. An energizing circuit may be traced from switch 100 through conductor 127, transformer primary winding 102, conductor 130, terminal 95, and conductor 131 to junction point 125, but no complete secondary circuit exists at this time.

Water passes into header 16 and stand-pipe 90, rising in both to the same extent. Although water is not an excellent electrical conductor, its conductance is sufficient to act as a switch between probes 91 and 92, respectively, and stand-pipe 90 to cause energization of relay 104. As the water level reaches the tip of probe 91, no circuit change takes place, as will be explained below, but when the water reaches the tip of probe 92, a circuit is completed from transformer secondary winding 103 through conductor 132, stand-pipe 90 or its electrode 97, the water, probe 92, conductor 133, junction point 134, conductor 135, relay winding 105, and conductor 136 to secondary winding 103. This energizes relay 104, opening contacts 107 and 110 to deenergize valve 86, thus interrupting the supply of water, and closing contacts 111 and 112 to complete a circuit from junction point 134 through conductor 137, relay contacts 111 and 112, and conductor 140 to probe 91. As will be seen, this circuit is in parallel with the circuit including probe 92 and conductor 133.

As water is vaporized, the level in the stand-pipe slowly falls. When it drops below probe 92, no circuit change occurs, but when it drops below probe 91, the energizing circuit for relay 104 is opened and the relay releases, reenergizing the valve 86 at contacts 107 and 110, and deenergizing probe 91 at contacts 111 and 112. The water level is thus maintained between the tips of probes 91 and 92.

It will be realized that other forms of liquid level control are also available.

When burner 76 is in operation, an axially directed flame in the combustion chamber bathes the inside of the water tube structure portions. Hot combustion products pass upwardly through the spaces 43. The spent gases also pass under plate 71, and are directed upwardly by plate 43 so that they pass around header 47 and conduits 45 before leaving housing 10 at vent 25.

A slight modification of the invention is shown in FIG. 5. Here the tube structure 40′, instead of being a continuous helix, is made up of a plurality of discrete rings 120 or annuli of pipe. The rings are mounted in spaced relation along a common horizontal axis to comprise the wall of a combustion chamber, as before, and are provided upwardly with taps 44′ and downwardly with taps 55′ which connect respectively with conduits 45′ and 56′, as in FIG. 2, communicating with the steam and water headers 47′, 60′, respectively, through taps 46′, 57′. The same baffle arrangement 66′ and 70′ is provided in this second embodiment of the invention, as well as the remaining components of the first embodiment, not further described.

From the above, it will be apparent that we have invented a new low pressure steam generator which, in addition to being made in large part of standard components of proven reliability, is not only inexpensive to manufacture, but is inherently safe. It is readily transportable, and can be used wherever water and electricity are available.

Numerous characteristics of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a low pressure steam generator:

a water tube structure comprising a plurality of generally annular portions slightly spaced from one another along a common horizontal axis to define a hollow laterally discontinuous combustion chamber;

an elongated water header having an axis parallel to said common axis and located below said water tube structure;

means individually connecting the bottoms of said annular portions with said water header;

an elongated steam header having an axis parallel to said common axis and located above said water tube structure;

and means individually connecting the tops of said annular portions with said steam header.

2. In a low pressure steam generator:

a water tube structure comprising a plurality of generally annular portions slightly spaced from one another along a common horizontal axis to define a hollow laterally discontinuous combustion chamber;

an elongated water header having an axis parallel to said common axis and located below said water tube structure;

means individually connecting the bottoms of said annular portions with said water header;

an elongated steam header having an axis parallel to said common axis and located above said water tube structure;

and means individually connecting the tops of said annular portions with said steam header;

in which said annular portions comprise successive turns of a continuous helically configured tube having closed ends.

3. Apparatus according to claim 1 together with level control means connected with said water header for maintaining water in said portions at a point above said common axis and below said steam header.

4. In a low pressure steam generator:

a water tube structure comprising a plurality of generally annular portions slightly spaced from one another along a common horizontal axis to define a hollow laterally discontinuous combustion chamber;

an elongated water header having an axis parallel to said common axis and located below said water tube structure;

means individually connecting the bottoms of said annular portions with said water header;

an elongated steam header having an axis parallel to said common axis and located above said water tube structure;

and means individually connecting the tops of said annular portions with said steam header;

together with baffle means carried by said structure for coacting therewith to define a combustion chamber;

together with means directing a heating flame substantially along said axis within said combustion chamber;

in which the products of combustion of said flame are directed by said baffle means to pass around said steam header mixed with products of combustion rising from said chamber through the spaces between said portions of said tube structure.

5. A low pressure steam generator comprising, in combination:

a housing having gas inlet and outlet means;

a water tube structure comprising a plurality of generally annular portions slightly spaced from one another along a common horizontal axis;

an elongated water header having an axis parallel to said common axis and located below said water tube structure;

means individually connecting the bottoms of said annular portions with said water header;

an elongated steam header having an axis parallel to said common axis and located above said water tube structure;

means individually connecting the tops of said annular portions with said steam header;

means supporting said headers from said housing;

means supplying water to said water header so as to maintain water in said structure at a level above the height of said axis;

baffle means carried by said structure for coacting therewith to define a hollow combustion chamber;

means in said housing at one end thereof for directing a heating flame substantially along said axis within said combustion chamber;

means including said baffle means at the other end of said chamber for causing products of combustion of said flame to be redirected and passed around said steam header mixed with products of combustion arising from said chamber through the spaces between said portions of said tube structure, so that combustion air enters said housing through said gas inlet and combustion products leave said housing through said outlet means;

and means including a pressure relief valve for dispensing steam from said steam header.

* * * * *

UNITED STATES PATENT OFFICE

CERTIFICATE OF CORRECTION

Patent No. 3,970,048 Dated July 20, 1976

Inventor(s) John F. Finger et al.

It is certified that error appears in the above-identified patent and that said Letters Patent are hereby corrected as shown below:

The second inventor's name should read -- Merle E. Pochop --.

Signed and Sealed this

Fifth Day of October 1976

[SEAL]

*Attest:*

RUTH C. MASON
*Attesting Officer*

C. MARSHALL DANN
*Commissioner of Patents and Trademarks*